US005267851A

United States Patent [19]

Washam et al.

[11] Patent Number: 5,267,851

[45] Date of Patent: Dec. 7, 1993

[54] SWIRL GUTTERS FOR ISOLATING FLOW FIELDS FOR COMBUSTION ENHANCEMENT AT NON-BASELOAD OPERATING CONDITIONS

[75] Inventors: Roy M. Washam, Schenectady; Bernard A. Thibault, Jr., Clifton Park, both of N.Y.

[73] Assignee: General Electric Company, Schenectady, N.Y.

[21] Appl. No.: 851,776

[22] Filed: Mar. 16, 1992

[51] Int. Cl.[5] ..... F23C 7/00

[52] U.S. Cl. ..... 431/9; 431/8; 431/183; 431/187; 60/737; 60/748; 60/749

[58] Field of Search ..... 431/9, 10, 182, 183, 431/187; 239/405, 461, 472, 590; 60/737, 747, 748, 749, 261

[56] References Cited

U.S. PATENT DOCUMENTS

| | | | |
|---|---|---|---|
| 1,102,510 | 7/1914 | Irish | 431/183 |
| 2,587,140 | 2/1952 | Gorshkoff | 239/472 |
| 3,031,012 | 4/1962 | Brola | 431/183 |
| 3,605,405 | 9/1971 | DuBelle et al. | 60/748 |
| 3,703,259 | 11/1972 | Sturgess et al. | 239/400 |
| 3,713,588 | 1/1973 | Sharpe | 239/400 |
| 3,937,011 | 2/1976 | Caruel et al. | 60/39.71 |
| 5,095,696 | 3/1992 | Gulati et al. | 60/749 |

FOREIGN PATENT DOCUMENTS

| | | | |
|---|---|---|---|
| 0093210 | 4/1990 | Japan | 60/737 |
| 793325 | 4/1958 | United Kingdom | 60/737 |

*Primary Examiner*—Carl D. Price
*Attorney, Agent, or Firm*—Nixon & Vanderhye

[57] ABSTRACT

A combustor includes inner and outer arrays of generally Vee-shaped, radially extending, circumferentially spaced gutters canted in a circumferential direction relative to one another to produce isolated concentric counter-rotating circumferentially directed flows downstream of the gutters. A lean premixed combustion mode is used at baseload operations. At non-baseload operations, particularly low-load operating conditions, a diffusion combustion mode is employed by direct fuel injection into air supplied to one of the isolated flow fields, preferably the radially inner flow field, to produce a stabilized, locally hotter flame, resulting in higher combustion efficiency and lower emissions than otherwise using a lean premixed combustion mode at the non-baseload operating conditions.

19 Claims, 3 Drawing Sheets

SWIRL GUTTERS FOR ISOLATING FLOW FIELDS FOR COMBUSTION ENHANCEMENT AT NON-BASELOAD OPERATING CONDITIONS

BACKGROUND AND SUMMARY OF THE INVENTION

The present invention relates to combustors for turbines and particularly relates to apparatus and methods for enhancing combustion at non-baseload operation conditions in an otherwise lean premixed gutter-stabilized combustion system.

Generally, two combustion techniques have been used in the past in combustors for turbines. One technique, known as a diffusion flame process, involves injecting fuel into the air flow through the combustor and burning the fuel as it mixes with the air. The advantages of the diffusion flame combustion technique include self-regulation, and flame stability under a wide variety of conditions. Thus, combustors employing the diffusion combustion process are designed to maintain the flame in a specific location and avoid blow-out and movement either upstream or downstream. Diffusion combustion processes, however, produce a very high flame temperature which, in turn, causes undesirable emissions such as high $NO_x$ emissions. With current emphasis on low-pollution, low-emission turbines, one method of reducing the high flame temperature in the diffusion combustion process, and hence the level of pollutants, is to provide air in excess of that necessary for complete combustion. In this process, fuel and air are premixed upstream of the burning zone of the combustor in a significantly lean fuel/air mixture. When the lean premixed fuel and air is introduced into the combustion zone, the mixture ignites and burns, resulting in a flame temperature that is reduced because of the available excess air.

Because the flame temperature is lower in lean premixed combustion systems, the flame is also more unstable than in the diffusion combustion system. To provide flame stability in a lean premixed combustion system, gutters are often employed upstream of the combustion zone to create low velocity, recirculating flow regions and hence hold the flame in these gutter wakes downstream of the gutters. Gutters have thus been used in lean premixed combustion processes to stabilize the burning process, while maintaining cooler flame temperatures with lower emissions.

Turbines are normally operated at baseload conditions in a lean premixed combustion mode at a predetermined fuel/air ratio. In turbines used, for example, for driving a generator and producing electricity, fuel/air ratios vary across the load. Thus, in industrial gas turbines operating at a single speed and at a constant air flow through the combustion system, any load reduction requires a corresponding reduction in fuel. While the turbine operates at the baseload condition for maximum efficiency, there are conditions such as ignition, acceleration of the rotor to operating speed, synchronization of the rotor with the generator, or low-load operation, situations where a non-baseload operating condition exists.

At these non-baseload, typically low-load conditions, where lower fuel/air ratios are used, the premixed lean burning process may potentially become unstable and inefficient and approach or cross the lean flammability limit where blow-out occurs. Consequently, at these non-baseload conditions, it has been found necessary to employ the diffusion combustion process rather than the lean premixed combustion process, because the diffusion combustion process is efficient and stable at low loads. Thus, fuel may be injected directly into the flow, for example, from the gutters or from the hub of the gutters used for the lean premixed operation. However, if the diffusion combustion process is used in a system geometrically designed for lean premixed combustion, the injected fuel mixes out into the excess air necessary to the lean premixed operation, resulting in undesirable emissions including carbon monoxide and unburned hydrocarbons. Consequently, in the evolution of the present invention, it has been found that, while a lean premixed combustor requires excess air at baseload operation, introducing a diffusion burning process into a fixed combustor geometry designed for lean premixed combustion, particularly at low fuel/air ratios, causes the flame to be inefficient and the fuel to be incompletely burned, hence releasing unburned hydrocarbons and carbon monoxide.

According to the present invention, advantage is taken of the geometry of the lean premixed combustor system for stabilizing the flame to produce flow conditions in the combustor to enhance the non-baseload or low-load burning process using the diffusion combustion process. This is accomplished in the present invention by segregating the flow through the combustor into discrete flow fields, each containing only a fraction of the total flow past the gutters which are used for stabilization of the flame in the lean premixed combustion process, and employing the diffusion combustion process in a limited number of the discrete flow fields. This aids ignition and low fuel-to-air ratio operation by creating a locally higher fuel-to-air ratio, enabling hotter and more complete combustion to occur than if all of the air were directly involved in the combustion. The localized hotter burning produces less carbon monoxide and unburned hydrocarbon emissions, while maintaining flame stability. The present invention thus uses the gutters employed in the lean premixed combustion process for flame stabilization to establish the discrete flow fields which afford both flame stability and higher combustion efficiency when using the diffusion combustion process in an otherwise fixed geometry combustor for lean premixed combustion operation.

More particularly, the gutters are arranged to produce counter-rotating concentric flow fields. That is, the gutters are arranged in the usual radial array for lean premixed combustion operation but are turned or canted at different radial locations to provide flow components at circumferentially opposite directions establishing respective discrete flow fields. Consequently, concentric counter-rotating swirling flow fields are provided within the combustion enclosure. These flow fields form an interface or shear layer which isolates the flows from one another. Direct injection of fuel may therefore be provided into a subset of the overall flow field, typically the radially innermost flow field, wherein a diffusion combustion process may be established within the above subset of the total flow field using only a fraction of the total air flow through the combustor. That is, the fuel is directly injected into a zone which has highly turbulent swirling air, and which is isolated from the remainder of the flow through the combustor by a shear layer established between the discrete flow fields.

Additionally, with the inner and outer gutter arrays affording concentric and discrete flow fields, it will be appreciated that one flow field, the radially inner flow field, has a higher concentration of gutter area and, hence, a higher blockage of the flow through the combustor. This permits greater recirculation within the downstream flow field and consequently enhanced flame stability and more time for the fuel introduced in the diffusion process to burn.

In a preferred embodiment according to the present invention, there is provided a combustor for a turbine comprising an enclosure for receiving a flow of lean premixed fuel and air and combustion thereof in a combustion zone for producing low emissions at baseload operation of the turbine, and an array of gutters disposed in the enclosure upstream of the combustion zone, the gutters having an elongated apex and surfaces divergent therefrom extending in a downstream direction in the enclosure for stabilizing the flame in the combustion zone when combusting the premixed fuel and air. The gutters are configured and arranged to isolate the flow through the enclosure downstream of the array of gutters into at least two discrete flow fields, each containing a fraction of the total flow past the gutters. Means are provided for introducing fuel into one or more of the discrete flow fields during turbine operation at non-baseload operating conditions to create in one discrete fluid flow field combustion by a diffusion process with a locally higher fuel-to-air ratio enabling hotter and more complete combustion at non-baseload conditions.

In a further preferred embodiment according to the present invention, there is provided a combustor for a turbine comprising an enclosure for receiving a flow of lean premixed fuel and air and combustion thereof in a combustion zone for producing low emissions at baseload operation of the turbine, means in the enclosure for stabilizing the flame in the combustion zone when combusting the premixed fuel and air and means for isolating the flow through the enclosure into at least two discrete flow fields each containing a fraction of the total flow through the enclosure. Means are provided for introducing fuel into at least one of the discrete flow fields during turbine operation at non-baseload conditions to create in at least one discrete fluid flow fields combustion by a diffusion process with locally higher fuel-to-air ratio enabling hotter and more complete combustion at lower than baseline operating conditions.

In a further preferred embodiment according to the present invention, there is provided a method of operating a combustor for a turbine, comprising the steps of providing a combustor having an enclosure, a combustion zone and an array of gutters upstream of the combustion zone, supplying a flow of lean, premixed fuel and air past the array of gutters for combustion in the combustion zone affording lean premixed low-emission turbine operation at baseload conditions, forming at least two discrete flow fields in the enclosure downstream of the array of gutters, with each flow field containing a fraction of the total flow past the array of gutters, isolating the flow fields one from the other to form an isolated combustion zone and providing fuel into the isolated combustion zone at non-baseload operating conditions to create a locally higher fuel-to-air ratio in the isolated combustion zone, enabling hotter and more complete combustion therein than if all the flow was involved in combustion in the entire combustion zone.

In a further preferred embodiment according to the present invention, there is provided a method of operating a combustor for a turbine, comprising the steps of providing a combustor having an enclosure and a combustion zone, supplying a flow of lean, premixed fuel and air into the combustion zone for combustion therein thereby affording lean premixed low-emission turbine operation at baseload conditions, forming at least two discrete flow fields in the enclosure, with each flow field containing a fraction of the total flow through the enclosure, isolating the flow fields one from the other to form an isolated combustion zone and providing fuel into the isolated combustion zone at non-baseload operating conditions to create a locally higher fuel-to-air ratio in the isolated combustion zone, enabling hotter and more complete combustion therein than if all the flow was involved in combustion in the entire combustion zone.

Accordingly, it is a primary object of the present invention to provide novel and improved apparatus and methods for facilitating operation of the combustor of a turbine designed for lean premixed gutter stabilized combustion at baseload operating conditions by enhancing the burning process when operating in a diffusion combustion mode at non-baseload conditions employing the geometry of the otherwise lean premixed gutter stabilized combustion system.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
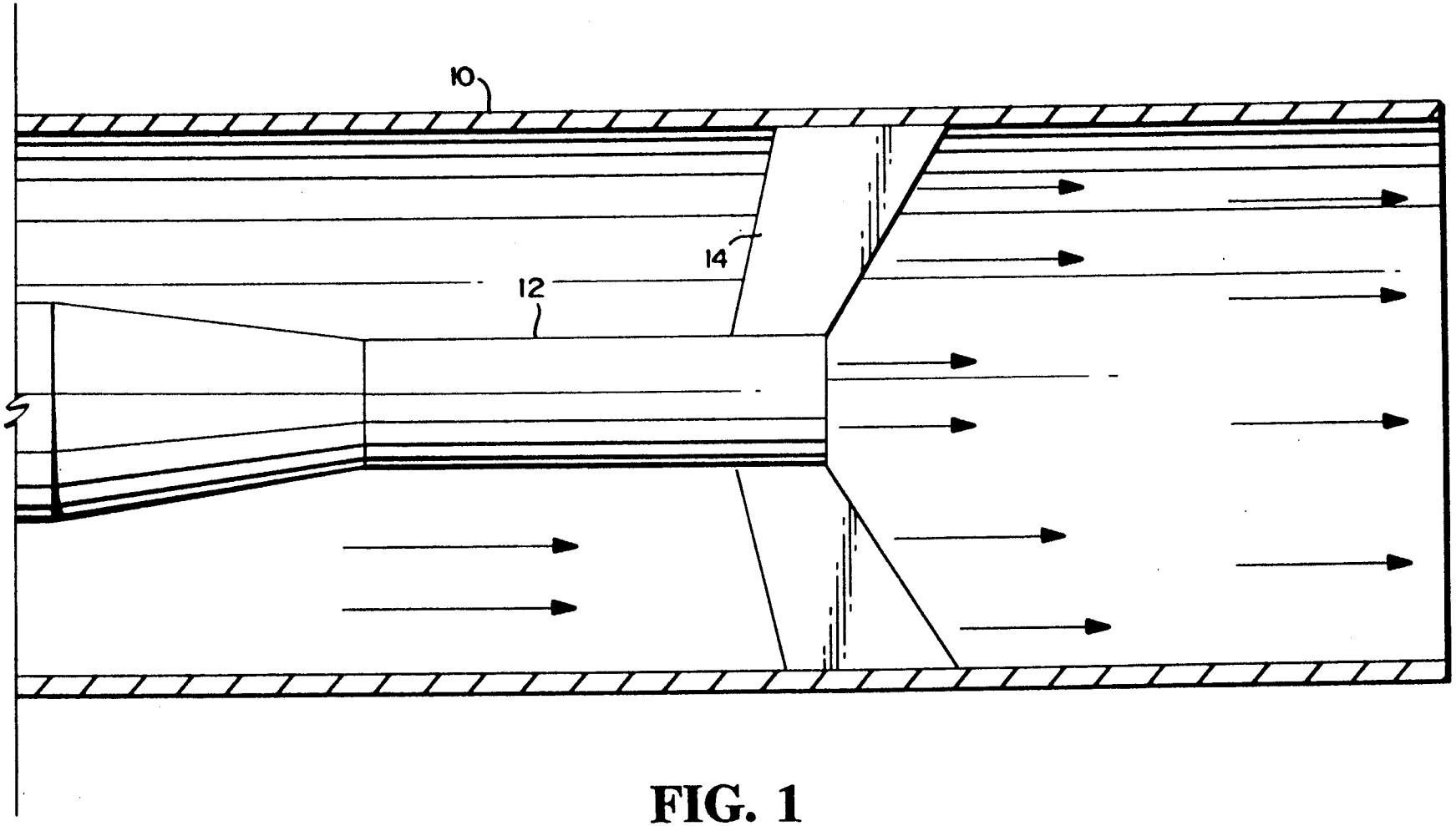
FIG. 1 PRIOR ART
FIG. 1 is a longitudinal cross-sectional view illustrating a schematic of a combustor of the prior art.

Referring to FIG. 1, there is illustrated a combustor of the prior art comprised of a generally cylindrical housing 10 having a central tube 12, which may comprise a fuel injector, and a plurality of radially extending, circumferentially spaced, generally Vee-shaped gutters 14 disposed in the air flow stream indicated by the straight arrows. In a combustor designed for lean premixed combustion, the Vee-shaped gutters have their apexes in the upstream direction with the legs of the Vee-shaped gutter extending at equal angles from the apex in opposite circumferential and downstream directions to provide a turbulent wake or trail downstream of the gutter establishing a recirculation region for stabilizing the flame. The premixed fuel and air is provided upstream of the gutters by any suitable means within the area within enclosure 10 outwardly of tube 12 or from within tube 12, or both. Lean premixed combustion then occurs in a combustion zone downstream of the gutters. As noted above, the lean premixed combustion mode is highly efficient with reduced emissions at baseload operations. However, at non-baseload operations, the fixed geometry of the system tends to introduce inefficiencies and higher emissions.

According to the present invention, as illustrated in FIGS. 2A–2E, there is provided a fixed geometry, lean premixed combustor system operable at high efficiency and low emissions at baseload conditions, yet enabling combustion by the diffusion process at non-baseload, e.g., lower-than-baseload, operating conditions whereby combustion efficiency and emissions are substantially improved. To accomplish this, and particularly with respect to FIGS. 2B and 2E, there is provided a combustor having a generally cylindrical enclosure 20, a central axially extending tube 22, which may be used for fuel injection purposes as described hereafter, and a plurality of radially extending, circumferentially spaced, Vee-shaped gutters, arranged in radially inner and outer arrays of gutters, designated 26 and 28, respectively. Each of the gutters 26 and 28 is formed in a generally Vee-shaped configuration having an apex (FIG. 2A) 30 and a pair of legs 32 and 34 extending from the apex in the downstream direction of flow through enclosure 20. The inner array of Vee-shaped gutters 26, however, are angled or canted such that its leg 34 extends at an angle to the axial direction of flow greater than the angle that the other leg 32 extends relative to the axial direction of flow. In a specific preferred embodiment, the leg 32 of the inner array of Vee-shaped gutters 26 extends generally parallel to the axial direction of flow.

Similarly, the Vee-shaped gutters 28 of the radially outer array thereof have their legs offset at an angle to the direction of flow. Particularly, in the outer set of gutters 28, the leg 32 of each gutter extends at a greater angle to the axial direction of flow than the leg 34, the latter leg preferably extending generally parallel to the axial direction of flow. Thus, the Vee-shaped gutters 26 and 28 are arranged such that the inner and outer gutters have legs extending in opposite directions at greater angles to the axial direction of flow than the other legs of the Vee-shaped gutters. By angling the legs in this manner, the gutters are configured and arranged to provide flow components in opposite circumferential directions, as illustrated by the arrows A and B, indicating the circumferential direction of flow downstream of the gutters as a result of their angulation relative to the axial direction of flow. As a consequence, two concentric isolated and counter-rotating flow fields or zones are formed downstream of the gutters, each containing a fraction of the total flow past the gutters. It will be appreciated that, for structural purposes, an intermediate section 24 is provided about the outer ends of the inner array of gutters 26 and at the inner ends of the outer array of gutters 28.

Figure 2A:
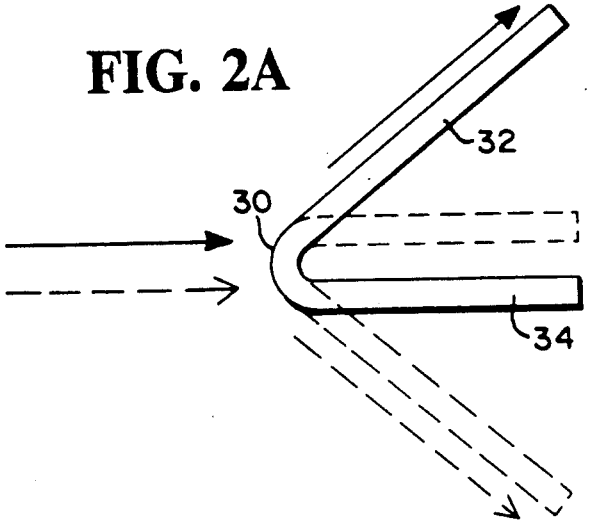
FIG. 2A is an end elevational view of a radially extending gutter illustrating its position in a flow stream for deflecting air flow into circumferentially directed components and taken generally about on lines 2A—2A in FIG. 2E.
Figure 2B:
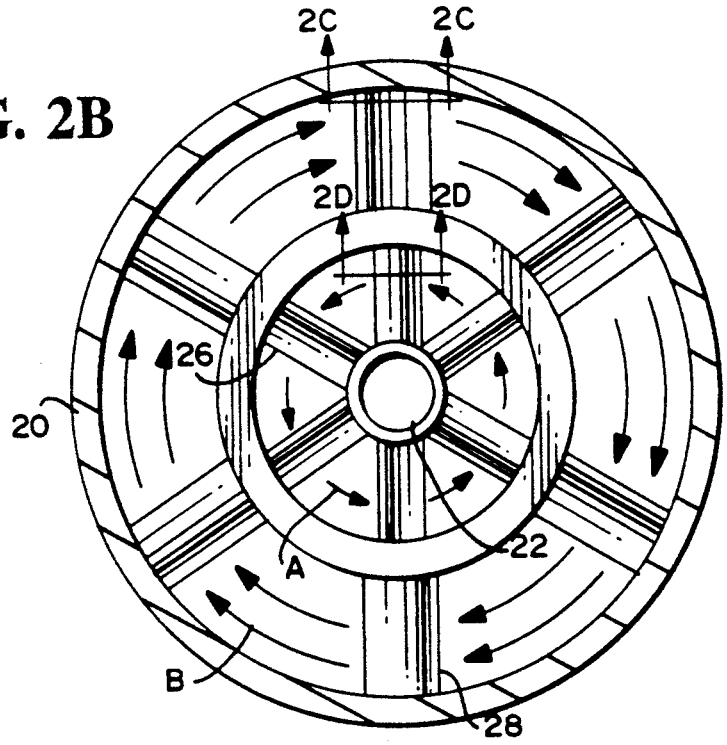
FIG. 2B is an end cross-sectional view of the combustor illustrated in FIG. 2E and taken generally about on line 2B—2B therein illustrating a swirl gutter arrangement according to the present invention for isolating flow fields for combustion enhancement at non-baseload operating conditions.
Figure 2C:
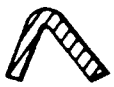
FIGS. 2C and 2D are respective cross-sectional views illustrating the gutters and taken generally about on lines 2C—2C and 2D—2D, respectively, in FIG. 2B.
Figure 2D:
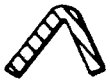
Figure 2E:
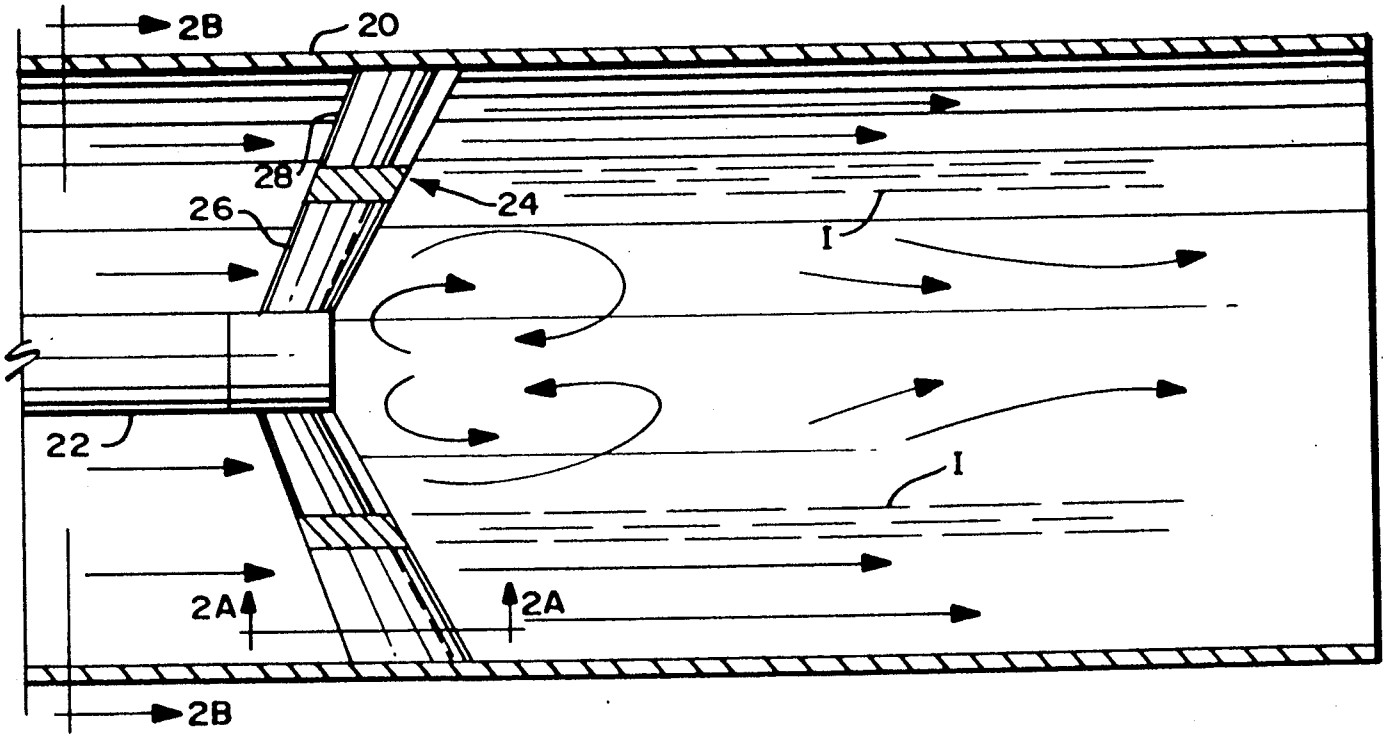
FIG. 2E is a view similar to FIG. 1 illustrating the swirl gutter arrangement according to the present invention in a combustor.

With reference to FIGS. 2B and 2E, the circumferentially directed, oppositely rotating, concentric flows established by the orientation and arrangement of the Vee-shaped gutters create an interface or shear layer between the two concentric flows downstream of the Vee-shaped gutters, as indicated at I. Thus, two discrete flow fields isolated one from the other, each containing a fraction of the total flow past the gutters, exists downstream of gutters 26 and 28.

The generally canted configuration of the inner and outer arrays of gutters 26 and 28 function substantially similarly as Vee-shaped gutters in prior combustion systems using the lean premixed combustion mode. That is, each of the Vee-shaped gutters of both the inner and outer arrays thereof creates a recirculating turbulent wake downstream from the gutter for flame stabilization purposes. The swirling action of the counter-rotating flows in the lean premixed mode has no detrimental effect in the lean premixed combustion process. By canting or angling the Vee-shaped gutters according to the present invention, enhancement of the combustion process at non-baseload operating conditions when it is desirable to use the diffusion combustion mode is provided. The shear layer I isolates the two concentric zones constituting the discrete flow fields. Thus, at non-baseload operating conditions, fuel may be injected through the central tube 22 directly into an air flow for burning in a diffusion combustion mode in one of the discrete flow fields or zones defined by the inner and outer arrays of gutters 26 and 28, respectively. For reasons discussed hereafter, the fuel is preferably injected in the zone defined by the inner array of gutters 26. Flame stabilization is enhanced in the diffusion combustion mode by the Vee-shaped gutters. Importantly, a locally higher fuel-to-air ratio is provided in only a portion of the total air flow through the enclosure, enabling hotter and more complete combustion to occur than if all the air flowing through enclosure 20 were directly involved in the combustion. The higher localized flame temperature produces less carbon monoxide and unburned hydrocarbon emissions. Note that the diffusion combustion mode provides for an isolated combustion zone within only a part of the entire combustion zone used when operating in the lean premixed combustion mode. No change in the geometry of the system is required for operation in either combustion mode.

The benefits of the present invention are also afforded by the introduction of the diffusion combustion mode in the isolated flow field caused by the inner array of gutters rather than in the flow field generated by the outer array of gutters. Because of the concentrated gutter area along the axis of the combustor, the inner array of gutters afford a higher degree of blockage of air flow and hence provide a greater recirculation of the flow through the combustor in that area. This recirculation provides additional time for the fuel introduced during the diffusion combustion mode to be burned. It will be appreciated, however, that the reverse configuration may be employed, i.e., providing for the diffusion combustion mode in the isolated outer flow field by increasing the blockage, i.e., increasing the number or area, or both, of the outermost array of Vee-shaped gutters 28.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of operating a combustor for a turbine, comprising the steps of:

providing a combustor having an enclosure and a combustion zone;

supplying a flow of lean, premixed fuel and air into said combustion zone for combustion therein thereby affording lean premixed low-emission turbine operation at baseload conditions;

forming at least two discrete flow fields in said enclosure, with each flow field containing a fraction of the total flow through said enclosure;

isolating said flow fields one from the other to form an isolated combustion zone; and providing fuel into said isolated combustion zone at non-baseload operating conditions to create a locally higher fuel-to-air ratio in said isolated combustion zone, enabling hotter and more complete combustion therein than if all the flow was involved in combustion in the entire combustion zone.

2. A method according to claim 1 wherein the step of forming includes creating a component of each flow field for flow in a circumferential direction.

3. A method according to claim 1 wherein the step of forming includes creating components of said flow fields for flow in opposite circumferential directions relative to one another.

4. A method according to claim 1 wherein the step of isolating includes forming a shear interface between the two flow fields to isolate one flow field from the other.

5. A method of operating a combustor for a turbine, comprising the steps of:

providing a combustor having an enclosure, a combustion zone and an array of gutters upstream of said combustion zone;

supplying a flow of lean, premixed fuel and air past said array of gutters for combustion in said combustion zone affording lean premixed low-emission turbine operation at baseload conditions;

forming at least two discrete flow fields in said enclosure downstream of said array of gutters, with each flow field containing a fraction of the total flow past said array of gutters;

isolating said flow fields one from the other to form an isolated combustion zone; and providing fuel into said isolated combustion zone at non-baseload operating conditions to create a locally higher fuel-to-air ratio in said isolated combustion zone, enabling hotter and more complete combustion therein than if all the flow was involved in combustion in the entire combustion zone.

6. A method according to claim 5 wherein the step of forming includes creating a component of each flow field for flow in a circumferential direction.

7. A method according to claim 5 wherein the step of forming includes creating components of said flow fields for flow in opposite circumferential directions relative to one another.

8. A method according to claim 5 wherein the step of isolating includes forming a shear interface between the two flow fields to isolate one flow field from the other.

9. A combustor for a turbine comprising:

an enclosure for receiving a flow of lean premixed fuel and air and combustion thereof in a combustion zone for producing low emissions at baseload operation of the turbine;

an array of gutters disposed in said enclosure upstream of said combustion zone, said gutters having an elongated apex and surfaces divergent therefrom extending in a downstream direction in said enclosure for stabilizing the flame in the combustion zone when combusting the premixed fuel and air;

said gutters being configured and arranged to isolate the flow through said enclosure downstream of said array of gutters into at least two discrete flow fields each containing a fraction of the total flow past said gutters; and means for introducing fuel into one or more of said discrete flow fields during turbine operation at non-baseload conditions to create in said one discrete fluid flow field combustion by a diffusion process with a locally higher fuel-to-air ratio enabling hotter and more complete combustion at non-baseload conditions.

10. A combustor according to claim 9 wherein said gutters are oriented in said combustor to create a flow component in a circumferential direction about the axis of flow through said enclosure to define said one flow field.

11. A combustor according to claim 9 wherein said gutters are oriented in said combustor to create flow components in opposite circumferential directions about the axis of flow through said enclosure to define two discrete flow fields, said one flow field comprising one of the two discrete flow fields.

12. A combustor according to claim 11 wherein said gutters are arranged and oriented such that the separate flow fields are substantially concentric relative to one another and interface one with the other to create a shear flow layer between the oppositely directed flows for substantially isolating the flow fields one from the other.

13. A combustor according to claim 12 wherein said fuel introducing means introduces fuel into the radially inner flow field of the concentric flow fields.

14. A combustor according to claim 12 wherein said gutters are arranged substantially radially about the axis of the enclosure with the surfaces of the gutters at radially inner and outer positions extending respectively at angles on opposite sides of an axial plane passing through the gutter and the axis of the enclosure, the angle of the one surface of each gutter relative to the axial plane being greater than the angle of the other surface of said gutter relative to the axial plane.

15. A combustor for a turbine comprising:

an enclosure for receiving a flow of lean premixed fuel and air and combustion thereof in a combustion zone for producing low emissions at baseload operation of the turbine;

means in said enclosure for stabilizing the flame in the combustion zone when combusting the premixed fuel and air;

means for isolating the flow through said enclosure into at least two discrete flow fields each containing a fraction of the total flow through said enclosure; and means for introducing fuel into at least one of said discrete flow fields during turbine operation at non-baseload conditions to create in said at least one discrete fluid flow field combustion by a diffusion process with a locally higher fuel-to-air ratio enabling hotter and more complete combustion at said non-baseload BAT conditions.

16. A combustor according to claim 15 wherein said isolating means are arranged to create a flow component in a circumferential direction about the axis of flow through said enclosure to define said one flow field.

17. A combustor according to claim 15 wherein said isolating means are oriented in said combustor to create flow components in opposite circumferential directions about the axis of flow through said enclosure to define two discrete flow fields, said one flow field comprising one of the two discrete flow fields.

18. A combustor according to claim 17 wherein said isolating means are arranged such that the separate flow fields are substantially concentric relative to one another and interface one with the other to create a shear flow layer between the oppositely directed flows for substantially isolating the flow fields one from the other.

19. A combustor according to claim 18 wherein said fuel introducing means introduces fuel into the radially inner flow field of the concentric flow fields.

* * * * *